US006933495B1

(12) United States Patent
Yeom et al.

(10) Patent No.: US 6,933,495 B1
(45) Date of Patent: Aug. 23, 2005

(54) 3-GRID NEUTRAL BEAM SOURCE USED FOR ETCHING SEMICONDUCTOR DEVICE

(75) Inventors: Geun-Young Yeom, Seoul (KR); Do-Haing Lee, Kyeonggi-do (KR); Byoung-Jae Park, Chungcheongnam-do (KR)

(73) Assignee: Sungkyunkwan University, Seoul (KR)

( * ) Notice: Subject to any disclaimer, the term of this patent is extended or adjusted under 35 U.S.C. 154(b) by 0 days.

(21) Appl. No.: 10/814,148

(22) Filed: Apr. 1, 2004

(30) Foreign Application Priority Data

Feb. 27, 2004 (KR) ..... 10-2004-0013484

(51) Int. Cl.[7] ..... H05H 3/02
(52) U.S. Cl. ..... 250/251
(58) Field of Search ..... 250/251

(56) References Cited

U.S. PATENT DOCUMENTS 4,775,789 A * 10/1988 Albridge et al. ..... 250/251
2002/0033446 A1 * 3/2002 Ichimura et al. ..... 250/251
2004/0016876 A1 1/2004 Yeom et al.

OTHER PUBLICATIONS

Korean Patent Abstracts, KO-10-2002-092482 (Dec. 12, 2002), 2 pp., Abstract only.
Korean Patent Abstracts, KO-10-2003-042958 (Jun. 2, 2003) 2 pp., Abstract only.

* cited by examiner

*Primary Examiner*—Jack I. Berman
(74) *Attorney, Agent, or Firm*—Foley & Lardner LLP

(57) ABSTRACT

Disclosed is a 3-grid neutral beam source used for etching a semiconductor device. The 3-grid neutral beam source includes a plasma generating chamber, a grid assembly including first to third grids, which are sequentially overlapped with each other by interposing an insulation material therebetween for obtaining a great amount of ion flux at a low ion energy, and a reflective member for converting an ion beam into a neutral beam by reflecting the ion beam. The semiconductor device is prevented from being damaged due to reduced kinetic energy of ions, and an etch rate of the semiconductor device is improved.

8 Claims, 7 Drawing Sheets

PRIOR ART

PRIOR ART

3-GRID NEUTRAL BEAM SOURCE USED FOR ETCHING SEMICONDUCTOR DEVICE

BACKGROUND OF THE INVENTION

1. Field of the Invention

The present invention relates to a 3-grid neutral beam source used for etching semiconductor device, and more particularly to a 3-grid neutral beam source used for etching a semiconductor device and capable of obtaining a great amount of ion flux at low energy by improving a grid structure of a conventional neutral beam source converting ion beams into neutral beams.

2. Description of the Prior Art

As generally known in the art, an ion beam source is technically used in a field requiring a uniform beam distribution over a large area. Particularly, such an ion beam source has been widely used in a semiconductor field, so as to implant impurities into a semiconductor substrate, deposit a predetermined material layer on the semiconductor, or etch a material layer formed on the semiconductor. Herein, the ion beam source ionizes gas so as to supply ion gas into a require place.

However, in a conventional etching device using the ion beam source, a great amount of ions may exist in a conventional etching device for performing an etching process and such ions may collide with a semiconductor substrate or material layers formed on the semiconductor substrate with hundreds of eV energies, thereby causing electrical damage or physical damage to the semiconductor substrate or material layers formed on the semiconductor substrate.

To solve the above problem, applicant of the present invention has filed a Patent application with Korean intellectual property office entitled "Ion beam source capable of improving ion flux", which is now pending with Korean laid-open publication No. 2002-92482.

In the accompanying drawings, FIG. 1 schematically shows an inductively coupled RF (radio frequency) ion source 10' having an RF coil.

Referring to FIG. 1, the inductively coupled RF ion source 10' includes a plasma generating chamber 11' made of quartz. In addition, a gas feeding port 19' is formed at a top of the plasma generating chamber 11' in order to feed reaction gas into the plasma generating chamber 11'. An inductive coil 14' is wound around the plasma generating chamber 11'. The inductive coil 14' is connected to an RF matchbox 12', which is connected to an RF power supply 13' for supplying RF power.

In addition, a dual grid assembly 15' having a plurality of ion beam paths 150' is provided at a bottom of the inductively coupled RF ion source 10' in order to control an extraction of ions from the plasma generating chamber 11'.

As mentioned above, in an etching device using the ion beam source, a great amount of ions may exist in the etching device for performing an etching process and such ions may collide with a semiconductor substrate or material layers formed on the semiconductor substrate with hundreds of eV energy, thereby causing electrical damage or physical damage to the semiconductor substrate or the material layers formed on the semiconductor substrate.

To solve the above problem, applicant of the present invention has filed a Patent application with Korean intellectual property office entitled "Neutral beam etching device", which is now allowed to applicant of the present invention with Korean Patent No. 10-412953.

The etching device disclosed in the above patent includes an ion source having a plasma generating chamber for extracting ion beams, a dual grid assembly positioned at a bottom of the ion source, and a reflective member positioned at a lower end of the dual grid assembly.

FIGS. 2A and 2B are photographic views showing variation of ion density when voltage is applied to a dual grid assembly in a neutral beam etching device disclosed in the above patent. See Appendix A for a color version of these drawings;

Referring to FIG. 2A, voltage applied to a first grid 15*a*' does not sufficiently exert an influence to the plasma generating chamber, so ion density in the plasma generating chamber becomes high and an acceleration degree and a flow rate of ions passing through the ion beam paths 150' become low.

Referring to FIG. 3B, voltage applied to the first grid 15*a*' is significantly lowered at a second grid 15', and at the same time, an amount of ion flux becomes reduced.

Accordingly, a conventional neutral beam etching device utilizing a dual grid must increase voltage applied to the grids in order to increase an amount of ions, that is, in order to increase an acceleration degree and a flow rate of ions passing through the grid assembly. Therefore, ion energy is also increased. However, if the ion energy is increased, kinetic energy of ions is also increased, so a semiconductor substrate may be damaged due to the ions making contact with the semiconductor substrate while an etching process is being carried out.

SUMMARY OF THE INVENTION

Accordingly, the present invention has been made to solve the above-mentioned problems occurring in the prior art, and an object of the present invention is to provide a 3-grid neutral beam source used for etching a semiconductor device and capable of improving etching performance without damaging a semiconductor substrate by adding a grid assembly including grids having acceleration, grounding and deceleration functions to a conventional neutral beam etching device in such a manner that an amount of ion flux can be increased under low energy due to a potential difference between an accelerating grid and a grounding grid and ion energy can be reduced at a deceleration grid installed in a rear end of the grid assembly.

In order to accomplish this object, there is provided a 3-grid neutral beam source comprising: a plasma generating chamber; a grid assembly including first to third grids, which are sequentially overlapped with each other by interposing an insulation material therebetween for obtaining a great amount of ion flux at a low ion energy, and a reflective member for converting an ion beam into a neutral beam by reflecting the ion beam.

According to the preferred embodiment of the present invention, the first grid is connected to a positive voltage power supply, the second grid is connected to a ground, and the amount of ion flux is increased due to a potential difference between the first and second grids.

The first positive voltage is applied to the first grid, which is positioned uppermost portion of the grid assembly adjacent to the plasma generating chamber, in order to accelerate ion beams, and a second positive voltage is applied to the third grid, which is positioned lowest portion of the grid assembly, so as to prevent the ion beams from obtaining a high energy during a neutralization process.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described-in detail with reference to accompanying drawings.

Figure 3:
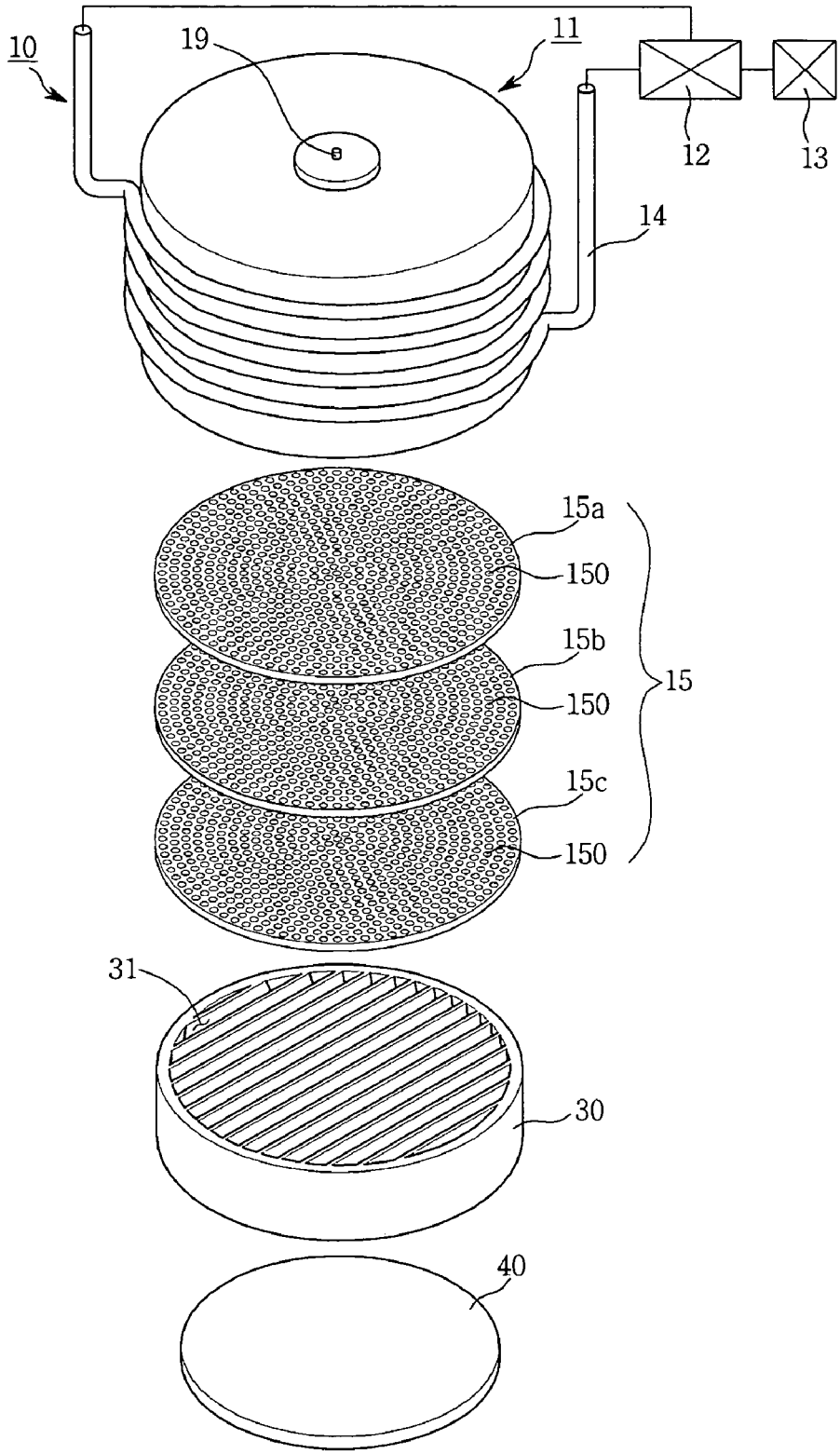
FIG. 3 is an exploded perspective view showing a 3-grid neutral beam source used for etching a semiconductor device according to one embodiment of the present invention.
Figure 4:
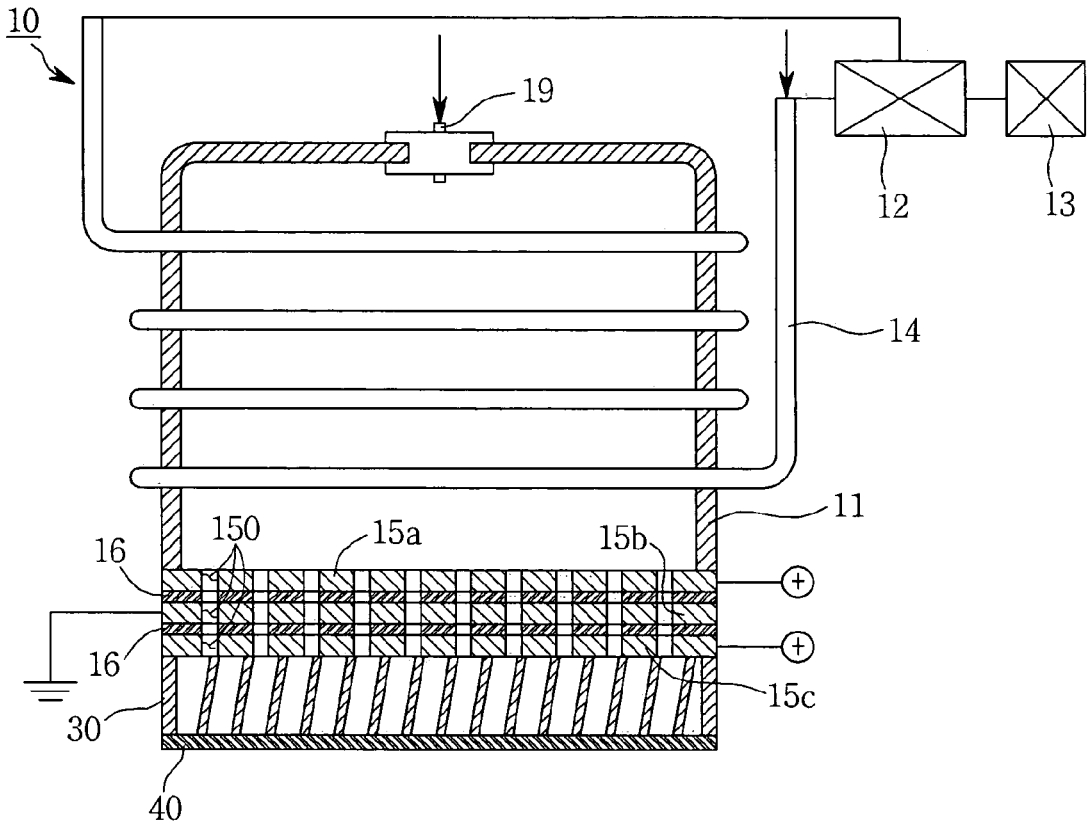
FIG. 4 is a sectional view of the 3-grid neutral beam source shown in FIG. 3.
Figure 5A:
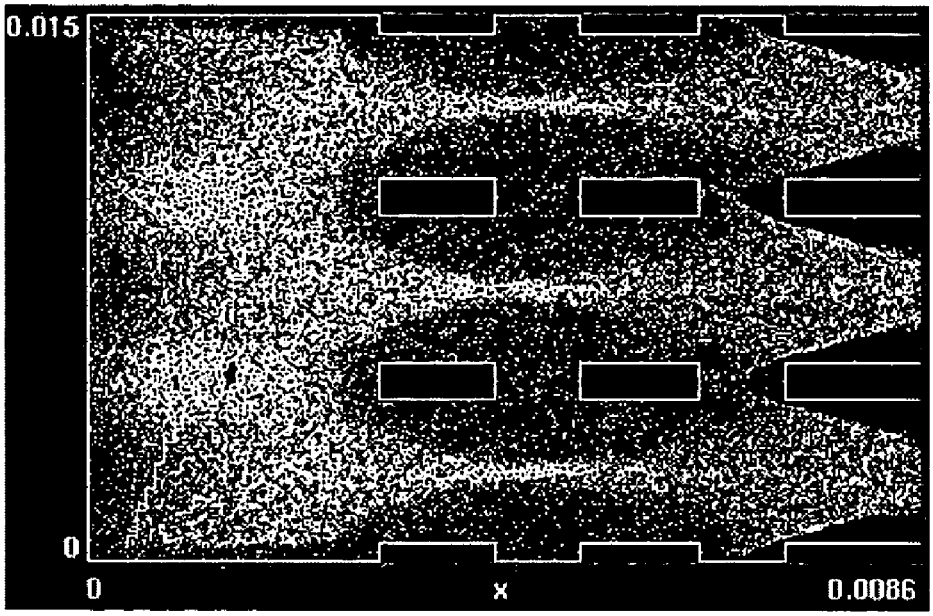
FIG. 5A is a photographic view showing ion density if a 3-grid neutral beam source according to one embodiment of the present invention. See Appendix A for a color version of this Figure.
Figure 5B:
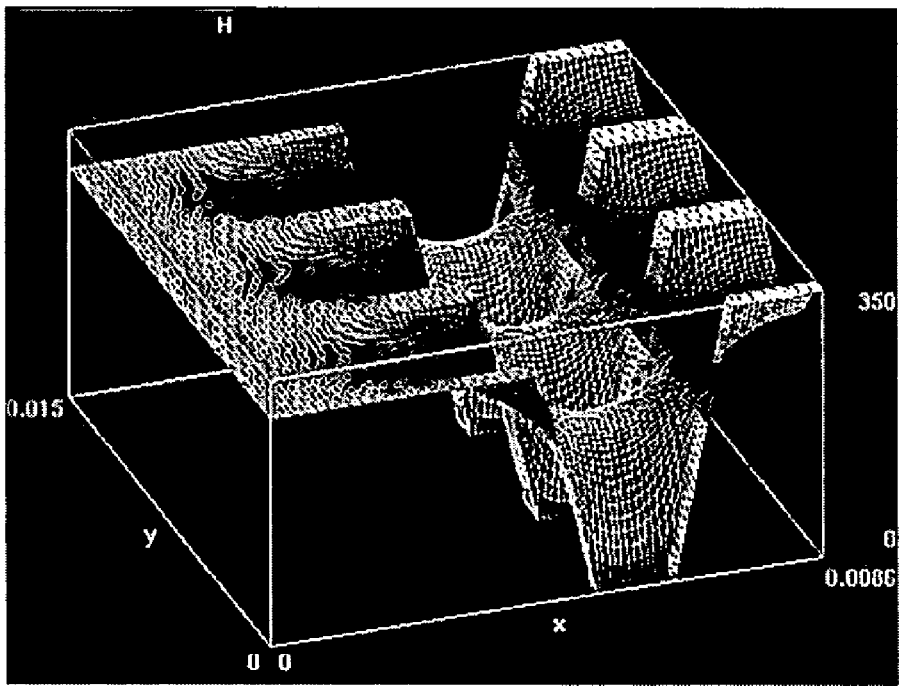
FIG. 5B is a photographic view showing variation of voltage in a 3-grid neutral beam source according to one embodiment of the present invention. See Appendix A for a color version of this Figure.
Figure 6:
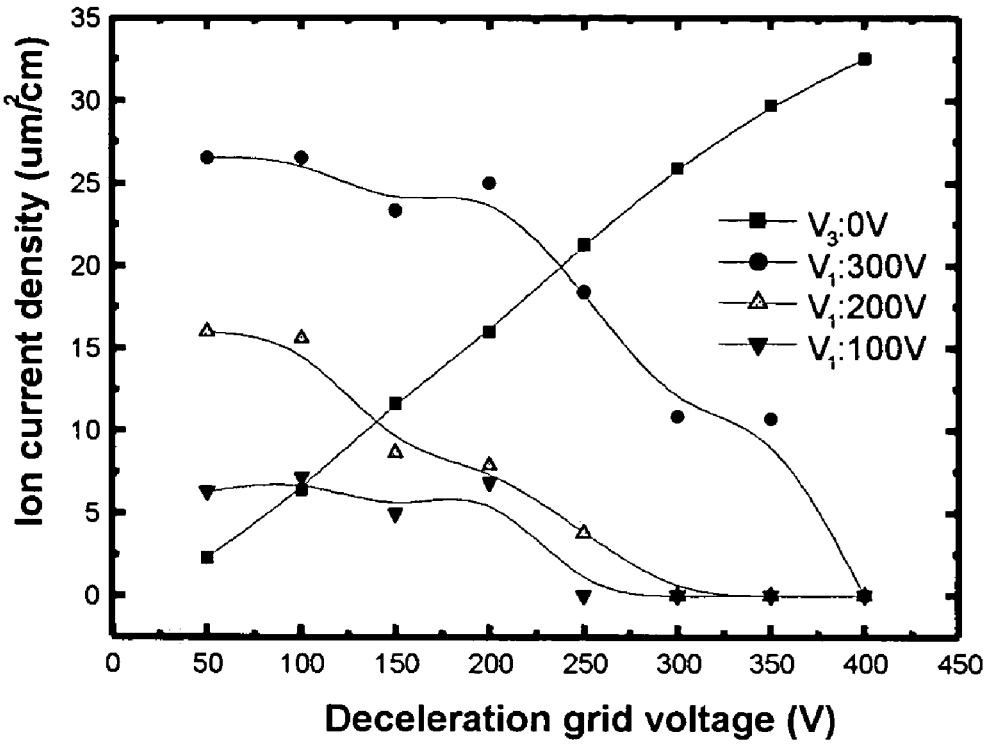
FIG. 6 is a graph showing an amount of ions created as a function of accelerating voltage created in a 3-grid neutral beam source according to one embodiment of the present invention and a conventional dual grid neutral beam source, respectively.
Figure 7A:
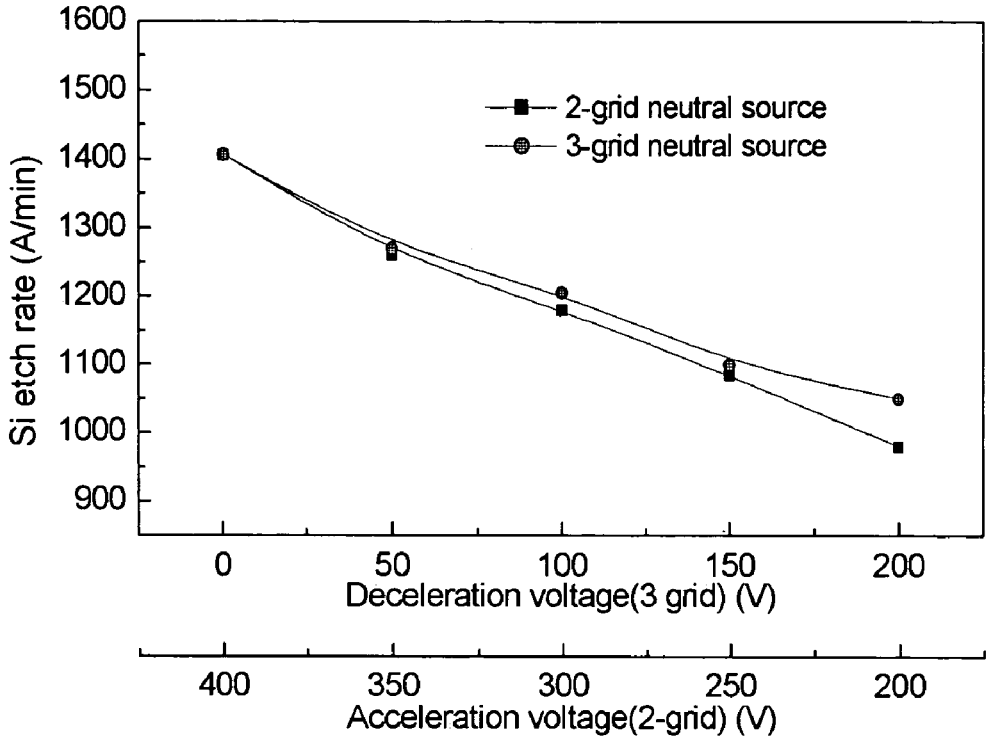
FIGS. 7A and 7B are graphs showing etching results when Si and $SiO_2$ are etched by using a 3-grid neutral beam source according to one embodiment of the present invention and by using a conventional dual grid neutral beam source, respectively.
Figure 7B:
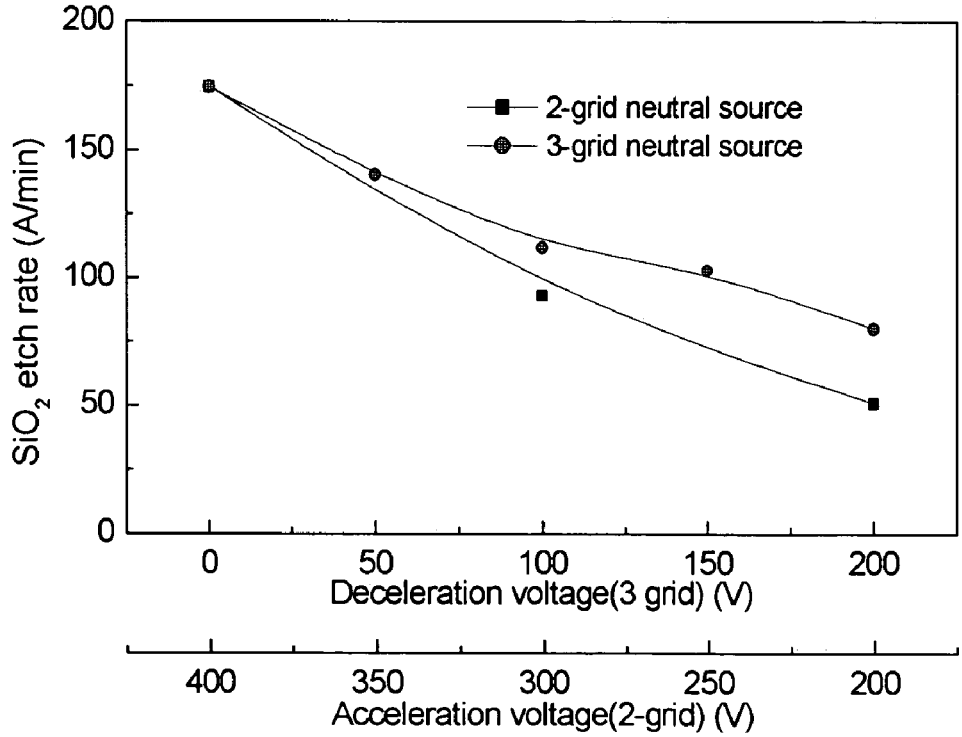

In the accompanying drawings, FIG. 3 is an exploded perspective view showing a 3-grid neutral beam source used for etching a semiconductor device according to one embodiment of the present invention, FIG. 4 is a sectional view of the 3-grid neutral beam source shown in FIG. 3, FIG. 5A is a photographic view showing ion density in a 3-grid neutral beam source according to one embodiment of the present invention, FIG. 5B is a photographic view showing variation of voltage in a 3-grid neutral beam source according to one embodiment of the present invention, FIG. 6 is a graph showing an amount of ions created as a function of accelerating voltage created in a 3-grid neutral beam source according to one embodiment of the present invention and a conventional dual grid neutral beam source, respectively, and FIGS. 7A and 7B are graphs showing etching results when Si and $SiO_2$ are etched by using a 3-grid neutral beam source according to one embodiment of the present invention and by using a conventional dual grid neutral beam source, respectively.

The present invention is an improvement of Korean Patent No. 10-412953 entitled "Neutral beam etching device" and allowed to applicant of the present invention, the contents of which are hereby incorporated by reference. The present invention includes an ion source, a grid assembly, and a reflective member disclosed in above Korean Patent No. 10-412953 as main components.

According to the present invention, a grid assembly 15 is formed by sequentially overlapping first to third grids 15*a* to 15*c* with each other at a lower portion of a plasma generating chamber 11 as shown in FIG. 3.

In addition, positive voltage is applied to the first grid 15*a* (acceleration grid) formed at an uppermost portion of the grid assembly 15. The second grid 15*b* (ground grid) adjacent to a lower portion of the first grid 15*a* is connected to a ground and positive voltage is applied to the third grid 15*c* (deceleration grid) adjacent to a lower portion of the second grid 15*b*.

The plasma generating chamber 11 is provided at a top thereof with a gas feeding port 19 for feeding reaction gas into the plasma generating chamber 11. An inductive coil 14 is wound around the plasma generating chamber 11. The inductive coil 14 is connected to an RF match box 12, which is connected to an RF power supply 13 for supplying RF power.

A positive voltage power supply is connected to the first grid 15*a* in order to apply high positive voltages (from several tens of voltages to hundreds of voltages) to the first grid 15*a*.

The second grid 15*b* maintains a "0 voltage" state due to the ground.

Positive voltage, which is lower than positive voltage applied to the first grid 15*a*, is applied to the third grid 15*c* in such a manner that ions do not obtain high energy during a neutralization process.

An insulation member 16 made of insulation material is formed among first to third grids 15*a* to 15*c*. At this time, the insulation member 16 is located at outer peripheral portions of the first to third grids 15*a* to 15*c* such that ion beam paths 150 formed in the first to third grids 15*a* to 15*c* are communicated with each other.

The insulation material is any one selected from the group consisting of oxide-based material having dielectric constant of about 3 to 5, nitride-based material having dielectric constant of about 6 to 9, ferroelectric material having several tens of dielectric constant, and mixtures thereof.

In addition, a reflective member 30 is closely adjacent to a bottom portion of the third grid 15*c* in order to convert an ion beam into a neutral beam by reflecting the ion beam. The reflective member 30 includes a semiconductor substrate, $SiO_2$, or a metal substrate. It is also possible to use the above material only for an upper surface of the reflective member 30 defined by reflective holes 31.

At this time, positive voltage, which is the same as the positive voltage applied to the third grid 15*c*, is applied to the reflective member 30 so that ions passing through the reflective member 30 maintain constant energy.

The reflective member 30 is described in Korean Patent No. 10-412953 (neutral beam etching device) in detail, so it will not be further described below.

Hereinafter, an operation of the present invention will be described.

FIGS. 5A and 5B are photographic views showing variation if ion density when voltage is applied to the 3-grid neutral beam ion source of the present invention. See Appendix A for color versions of these figures.

Figure 1:
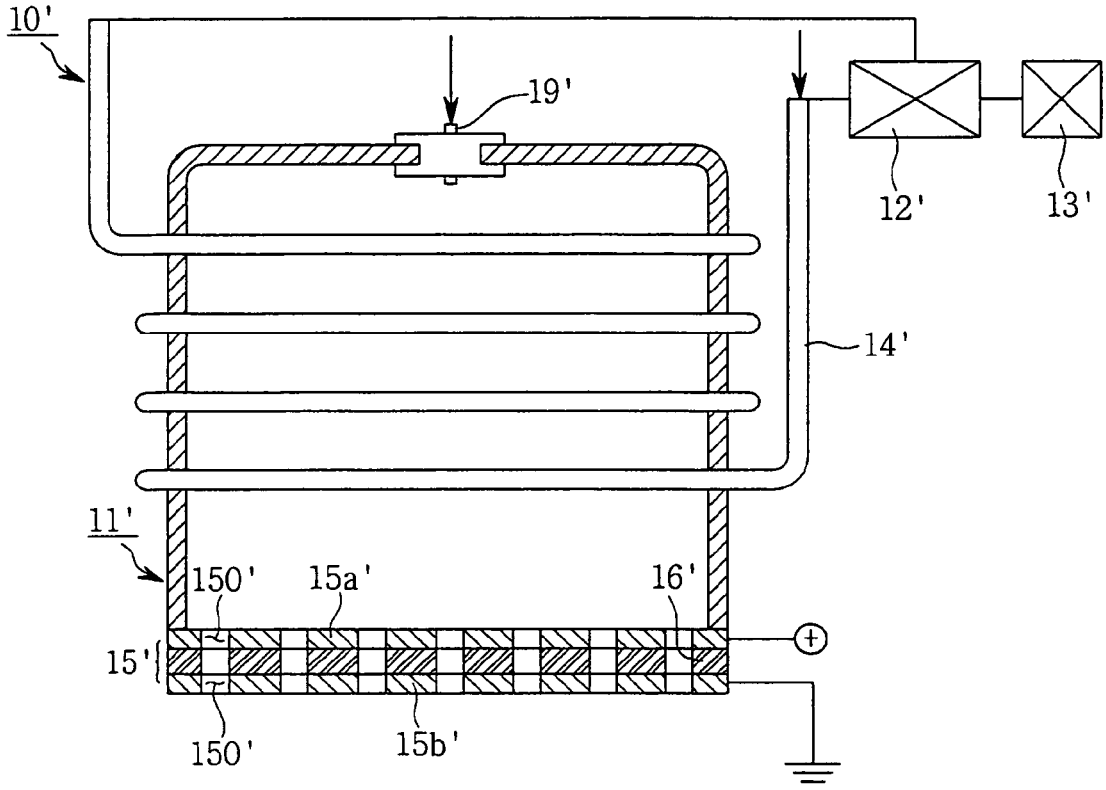
FIG. 1 is a view showing a conventional ion beam source.
Figure 2A:
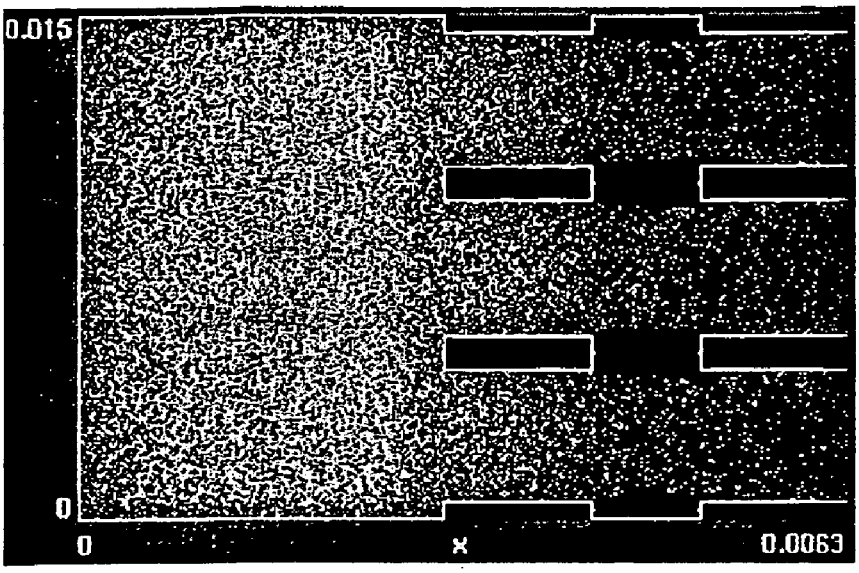
FIG. 2A is a photographic view showing ion density in the conventional ion beam source shown in FIG. 1. See Appendix A for a color version of this Figure.

Referring to FIG. 5A, voltage applied to the first grid 15*a* sufficiently exerts an influence to the plasma generating chamber 11, so ion density in the plasma generating chamber 11 is significantly lower than ion density in the conventional ion beam source (referred to FIG. 2A). In addition, an acceleration degree and a flow rate of ions passing through the ion beam paths 150 are significantly improved.

Figure 2B:
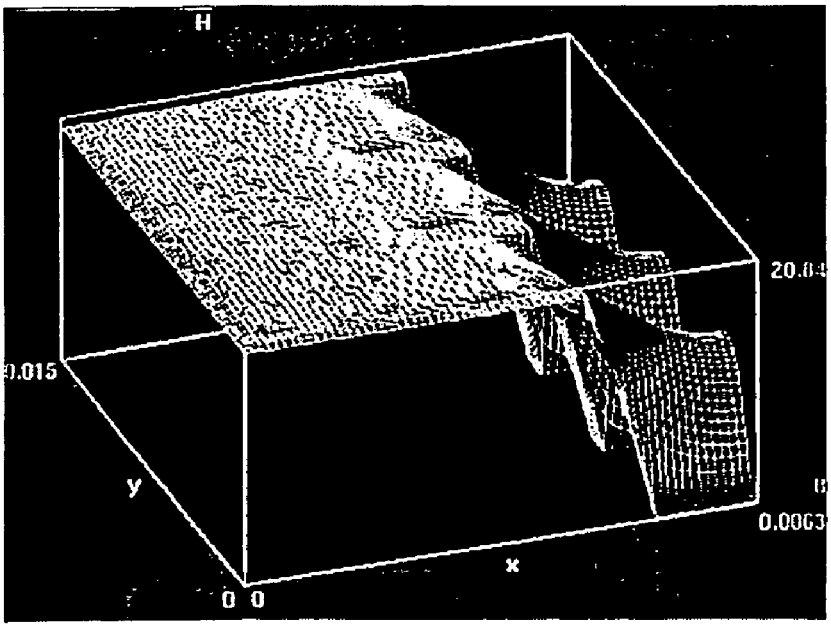
PRIOR ART FIG. 2B
FIG. 2B is a photographic view showing variation of voltage in the conventional ion beam source shown in FIG. 1. See Appendix A for a color version of this Figure.

Referring to FIG. 5B showing voltage variation, voltage applied to the first grid 15*a* is significantly lowered at the second grid 15*b*, and is again increased at the third grid 15*c*, so an amount of ions passing through the second and third grids 15*b* and 15*c* is significantly increased as compared with an amount of ions generated in the conventional ion beam source (referred to FIG. 2B).

FIG. 6 is a graph showing an amount of ions created as a function of accelerating voltage after the etching process has been carried out by using an etching device having the 3-grid neutral beam source according to one embodiment of the present invention and by using a conventional dual grid neutral beam etching device, respectively.

In detail, an x-axis of the graph represents voltage applied to a final grid (that is, the third grid) and a y-axis of the graph represent an amount of ions.

In addition, $V_2$ represents an amount of ion created as a function of accelerating voltage in the conventional dual grid neutral beam etching device, and $V_1$ represents an amount of ion created when accelerating voltages of 100V, 200V and 300V are applied to the first grid 15*a* in the 3-grid neutral beam etching device according to the present invention.

For example, when accelerating voltage of 300V is applied to first and final grids in the conventional dual gird neutral beam etching device, an amount of ions is about 26 to 27□/□.

In contrast, the 3-grid neutral beam etching device of the present invention can obtain such amount of ions about 26 to 27□/□ by applying voltage of 100V to the final gird (third grid) after applying voltage of 300V to the first grid.

Similarly, the conventional dual gird neutral beam etching device obtains an amount of ions about 15□/□ by applying accelerating voltage of 200V to the final grid. However, the 3-grid neutral beam etching device of the present invention can obtain such amount of ions about 15□/□ by applying voltage of 100V to the third gird after applying voltage of 200V to the first grid.

FIGS. 7A and 7B are graphs showing etching results when Si and $SiO_2$ are etched by using the 3-grid neutral beam source according to the present invention and by using the conventional neutral beam source, respectively.

At this time, the etching process is carried out under the condition of RF power about 1 KW with feeding $SF_6$ gas of 50 sccm. In the conventional dual grid neutral beam source, an etch rate is measured while applying voltages from 400V to 200V to the first grid (acceleration grid) adjacent to the plasma generating chamber. In addition, in the 3-grid neutral beam source according to the present invention, an etch rate is measured while applying voltages from 0V to 200V to the third grid (deceleration grid) in a state that voltage of 400V is constantly applied to the first grid 15*a* adjacent to the plasma generating chamber.

As can be seen from FIGS. 7A and 7B, the 3-grid neutral beam source according to the present invention represents the etch rate higher than the etch rate of the conventional dual grid neutral beam source.

As described above, the 3-grid neutral beam source used for etching the semiconductor device can significantly reduce ion energy while increasing an amount of ion flux because relatively low voltage, which is lower than voltage applied to the first grid, is applied to the third grid. Accordingly, the semiconductor substrate can be prevented from being damaged due to reduced kinetic energy of the ions, and the etch rate of the semiconductor substrate can be improved.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A 3-grid neutral beam source comprising:

a plasma generating chamber;

a grid assembly including first to third grids, which are sequentially overlapped with each other by interposing an insulation material therebetween for obtaining a great amount of ion flux at a low ion energy; and a reflective member for converting an ion beam into a neutral beam by reflecting the ion beam;

wherein the first grid is connected to a positive voltage power supply, the second grid is connected to a ground, and the amount of ion flux is increased due to a potential difference between the first and second grids.

2. A 3-grid neutral beam source comprising:

a plasma generating chamber;

a grid assembly including first to third grids, which are sequentially overlapped with each other by interposing an insulation material therebetween for obtaining a great amount of ion flux at a low ion energy; and a reflective member for converting an ion beam into a neutral beam by reflecting the ion beam;

wherein a first positive voltage is applied to the first grid, which is positioned at an uppermost portion of the grid assembly adjacent to the plasma generating chamber in order to accelerate ion beams, and a second positive voltage is applied to the third grid, which is positioned at a lowest portion of the grid assembly so as to prevent the ion beams from obtaining a high energy during a neutralization process, the first positive voltage being different from the second positive voltage.

3. The 3-grid neutral beam source as claimed in claim 2, wherein the first positive voltage is higher than the second positive voltage.

4. The 3-grid neutral beam source as claimed in claim 2, wherein the first positive voltage is lower than the second positive voltage.

5. A 3-grid neutral beam source comprising:

a plasma generating chamber;

a grid assembly including first to third grids, which are sequentially overlapped with each other by interposing an insulation material therebetween for obtaining a great amount of ion flux at a low ion energy; and a reflective member for converting an ion beam into a neutral beam by reflecting the ion beam;

wherein the first grid is connected to a positive voltage power supply, the second grid is connected to a ground, the amount of ion flux is increased due to a potential difference between the first and second grids, a first positive voltage is applied to the first grid, which is positioned at an uppermost portion of the grid assembly adjacent to the plasma generating chamber in order to accelerate ion beams, and a second positive voltage lower than the first positive voltage is applied to the third grid so as to decrease ion energy of ion beams.

6. A method of producing a neutral beam using a 3-grid neutral beam source having a grid assembly including first to third grids which are sequentially overlapped with each other by interposing an insulation material therebetween, the method comprising:

applying a positive voltage to the first grid;

applying a ground to the second grid;

accelerating ions to the first grid having an applied positive voltage; and converting an ion beam from the grid assembly into a neutral beam.

7. A method of producing a neutral beam using a 3-grid neutral beam source having a grid assembly including first to third grids which are sequentially overlapped with each other by interposing an insulation material therebetween, the method comprising:

applying a first positive voltage to the first grid;

applying a second positive voltage to the third grid, the first positive voltage being different from the second positive voltage;

accelerating ions to the first grid having an applied first positive voltage;

directing the accelerated ions from the first grid to the third grid where the second positive voltage is such so as to decrease the energy of ions from the first grid; and converting an ion beam from the grid assembly into a neutral beam.

8. The method of producing a neutral beam as claimed in claim 7, further comprising:

applying a ground to the second grid.

* * * * *